US005829367A

United States Patent [19]

Ohta et al.

[11] Patent Number: 5,829,367

[45] Date of Patent: Nov. 3, 1998

[54] PULVERIZED FUEL COMBUSTION BURNER HAVING A FLAME MAINTAINING PLATE AT A TIP END PORTION OF A PULVERIZED FUEL CONDUIT

[75] Inventors: Hideaki Ohta; Akiyasu Okamoto; Kimishiro Tokuda; Koutaro Fujimura; Hachiro Kawashima; Shouichi Kai, all of Nagasaki; Tadashi Gengo; Kouichi Sakamoto, both of Tokyo; Mutsuo Kuragasaki, Nagasaki, all of Japan

[73] Assignee: Mitsubishi Jukogyo Kabushiki Kaisha, Tokyo, Japan

[21] Appl. No.: 899,662

[22] Filed: Jul. 24, 1997

Related U.S. Application Data

[62] Division of Ser. No. 490,559, Jun. 15, 1995.

[30] Foreign Application Priority Data

| | | | |
|---|---|---|---|
| Jun. 17, 1994 | [JP] | Japan | 6-135806 |
| Jan. 30, 1995 | [JP] | Japan | 7-12541 |
| Feb. 24, 1995 | [JP] | Japan | 7-36623 |
| Apr. 25, 1995 | [JP] | Japan | 7-99357 |

[51] Int. Cl.[6] ..... F23K 3/02; F23D 1/00

[52] U.S. Cl. ..... 110/261; 110/264; 110/265; 110/104 B; 431/183; 431/187; 431/349; 431/350; 60/749

[58] Field of Search ..... 110/104 B, 260, 110/261, 262, 263, 264, 265; 431/8, 10, 183, 187, 349, 350; 60/749

[56] References Cited

U.S. PATENT DOCUMENTS

| | | | |
|---|---|---|---|
| 4,412,810 | 11/1983 | Izuha et al. | 431/186 |
| 4,455,949 | 6/1984 | Kretschmer et al. | 110/263 |
| 4,572,084 | 2/1986 | Green et al. | 110/261 |

(List continued on next page.)

FOREIGN PATENT DOCUMENTS

| | | | |
|---|---|---|---|
| 0 056 709 A2 | 8/1982 | European Pat. Off. . | |
| 0 284 629 | 10/1988 | European Pat. Off. . | |
| 0 489 928 A1 | 6/1992 | European Pat. Off. . | |
| 2 580 379 | 10/1986 | France . | |
| 63-65209 | 3/1988 | Japan | 110/347 |
| 3-110308 | 5/1991 | Japan . | |
| 4-214102 | 8/1992 | Japan . | |
| 4-122908 | 11/1992 | Japan . | |

OTHER PUBLICATIONS

"The DRB–XCL Burner: Proven Low $NO_x$ Experience," Babcock & Wilcox brochure (1993).

J. Piepho et al., "Seven Different Low–$NO_x$ Strategies Move from Demonstration to Commercial Status," Power–Gen '92 (Nov. 19, 1992).

(List continued on next page.)

*Primary Examiner*—Ira S. Lazarus
*Assistant Examiner*—Ljiljana V. Ciric
*Attorney, Agent, or Firm*—Wenderoth, Lind & Ponack, L.L.P.

[57] ABSTRACT

A burner for combustion of a pulverized coal mixture having two kinds of rich and lean concentration has a height of a burner panel reduced and the overall burner simplified. A rich/lean separator (10, 20, 30) is provided within a pulverized coal conduit (2) so that a high concentration mixture is formed in an outer peripheral portion and a low concentration mixture is formed in a central portion within a single pulverized coal conduit. Thus, a rich mixture burner and a lean mixture burner, which have been conventionally provided separately, may be formed into a single burner. Recirculation of air is accelerated by a cutaway slit (20*d*, 30*d*) provided in a central portion of the rich/lean separator to make the air flow rate distribution uniform in a pulverized coal nozzle. Also, a duct and an air blow box for the combustion air to be supplied to the pulverized coal flame are not integrally formed continuous in the height direction, but are divided into a plurality of discontinuous units.

8 Claims, 19 Drawing Sheets

U.S. PATENT DOCUMENTS

| | | | |
|---|---|---|---|
| 4,654,001 | 3/1987 | LaRue | 431/354 |
| 5,199,355 | 4/1993 | LaRue | 110/261 |
| 5,365,865 | 11/1994 | Monro | 110/264 |
| 5,415,114 | 5/1995 | Monro et al. | 110/347 |
| 5,529,000 | 6/1996 | Hartel et al. | 110/347 |
| 5,568,777 | 10/1996 | Breen et al. | 110/261 |
| 5,669,766 | 9/1997 | Hufton | 431/187 |
| 5,685,242 | 11/1997 | Narato et al. | 110/262 |

OTHER PUBLICATIONS

P.A. Toynbee, "Pulverised–Fuel Firing of Shell Boilers," First European Dry Fine Coal Conference (1987).

V. Wroblewska et al., *Biuletyn Institytutu Energetyka*, No. 7 (1978).

V. Wroblewska et al., *Archiwum Energetyki*, No. 2, pp. 97, 101, 114 (1975).

V. Bachmair, "Einfluss der Brennerkonstruktion auf die Feuerführung", *Mitteilungen der VGB*, vol. 64 pp. 8, 11, (1960).

T.F. Wall, *Principles of Combustion Engineering for Boilers*, pp. 262–263 and 296 (1987).

PULVERIZED FUEL COMBUSTION BURNER HAVING A FLAME MAINTAINING PLATE AT A TIP END PORTION OF A PULVERIZED FUEL CONDUIT

This is divisional application of Ser. No. 08/490,559, filed Jun. 15, 1995.

BACKGROUND OF THE INVENTION

The present invention relates to an improvement of a pulverized fuel combustion burner provided in a boiler furnace or a chemical industrial furnace.

A conventional pulverized coal burner, as one a pulverized fuel combustion burner, will now be explained with reference to FIGS. 28 and 29. Reference numeral 1 denotes an air blow box, numeral 2 denotes a pulverized coal conduit provided in a central portion of the air blow box 1, numeral 3 denotes a secondary air nozzle mounted at a front end portion of the air blow box 1, and numeral 4 denotes a flame maintaining plate mounted at a front end portion of the pulverized coal conduit 2. A passage (for the pulverized coal plus primary air) is formed within the pulverized coal conduit 2, and a passage (for secondary air) is formed between the air blow box 1 and the secondary air nozzle 3, and the pulverized coal conduit 2 and the flame maintaining plate 4.

In the pulverized coal burner shown in FIGS. 28 and 29, the combustion is maintained by secondary air after the self-flaming of the pulverized coal fed from the burner to the pulverized coal conduit 2 by radiation heat of the environment and a circulated eddy of the primary air formed on an inner surface of the flame maintaining plate 4.

The conventional pulverized coal burner shown in FIGS. 28 and 29 suffers from the following problems. First of all, in order to maintain a stable ignition of the pulverized coal, it is necessary to keep an A/C (primary air amount/pulverized coal amount) of the internal surface of the flame maintaining plate 4 in a range less than 2 to 2.5. However, as the combustion load is reduced, the A/C is increased (*1), resulting in an unstable ignition and an increase of NOx (*2).

*1: In order to maintain the pulverized coal delivery flow rate and in view of the practical use of the pulverizing mill, it is impossible to decrease the primary air amount below a predetermined level.

*2: In a certain range of the air ratio, there is a tendency that, the higher the air ratio of the ignition portion, the more Nox becomes generated in a main burner region. The farther the ignition point, the higher the air ratio becomes due to the diffusion of the secondary air. Accordingly, the NOx generation will become high.

Also, the pulverized coal fed from the burner into the pulverized coal conduit 2 is subjected to the self-framing effect by the radiation heat of the environment and the recirculation eddy of the primary air formed on the internal surface of the flame maintaining plate 4. The metal temperature of the flame maintaining plate 4 is kept at a high level so that clinker is liable to be stuck to the inner surface of the flame maintaining plate 4.

The clinker grows in a cracker manner on the inner surface of the flame maintaining plate 4 toward an outer edge portion, and finally projects from the secondary air blow outlet. It becomes a factor degrading the diffusion of the secondary air and preventing the effective combustion.

Also, in the conventional pulverized fuel combustion burner, a pulverized coal concentration distribution has not been imparted between the burner conduit central portion and the vicinity of the inner wall of the burner passage.

An example of another conventional pulverized coal burner is shown in FIGS. 30 and 31. It includes a pulverized coal delivery conduit 01, a pulverized coal mixture 02, a distributor 03, a burner 04, a pulverized coal conduit 2, a concentrated burner 06, a weak burner 07, secondary air 08, air blow box 1 and a secondary air nozzle 3.

The burner 04 is formed by integrally combining the concentrated burner 06 having a high concentration of the pulverized coal and the weak burner 07 having a low concentration of the pulverized coal. Each of the concentrated burner 06 and the weak burner 07 is composed of the pulverized coal conduit 2 disposed in the central portion thereof, the air blow box 1 surrounding its periphery, a rectangular pulverized coal nozzle 2*a* in communication with an outlet portion and the second air nozzle 3. The pulverized coal 02 that has been delivered through the pulverized coal delivery conduit 01 together with the primary air is distributed and fed to the concentrated burner 06 and the weak burner 07 by the distributor 03, respectively, and is injected into the furnace through the pulverized coal conduits 2 and the pulverized coal nozzles 2*a*. Thereafter, the pulverized coal is mixed and diffused with the secondary air 08 injected through the secondary air nozzles 3.

FIG. 32 is a graph showing a relationship between the air ratio and the generated NOx amount in combustion of the pulverized coal. In FIG. 32, a "volatile stoichiometric air amount" means the stoichiometric combustion air amount at which the volatile component contained in the coal may complete the combustion, and a "coal stoichiometric air amount" means the stoichiometric combustion air amount at which the coal itself may complete the combustion. As is apparent from FIG. 32, the NOx generation amount is reduced on both sides of the primary air/coal ratio of 3 to 4 (kg/kg coal) as a peak. In the pulverized coal burner, the pulverized coal mixture 02 is divided into a high concentration mixture and a low concentration mixture by the distributor 03, is introduced into the concentrated burner 06 and the weak burner 07, respectively, and is burnt at point $C_1$ and point $C_2$ (point $C_0$ in total), respectively to thereby suppress the generation of NOx and to stabilize the combustion.

Also, with respect to the pulverized coal burner to be applied to an actual system, a plurality of sets of burners each constructed as described above are assembled in the vertical direction into a one-piece type system continuous in the height direction of the furnace. Namely, as shown in FIG. 33, the duct and the burner blow box for the combustion air to be fed to the pulverized coal flame are of the one-piece type in the continuous form in the vertical direction. Also, the pulverized coal conduit for supplying the mixture of the pulverized coal and the air to the furnace is branched into a plurality of pipes having different concentrations in pulverized coal and the mixture is thus injected into the furnace.

The conventional pulverized coal burner suffers from the following problems. Since the duct and the air blow box for the combustion air to be supplied to the pulverized fuel flame is of the vertically continuous one-piece type, the overall height of the larger one reaches ten and several meters. Then, since the air blow box is mounted on boiler tubes, a thermal stress is generated due to a difference in elongation between the boiler tubes, kept at a high temperature, and the air blow box kept at a low temperature. There is a tendency that the higher the height of the air blow box, the larger the difference in elongation and the thermal stress will become. Accordingly, in the conventional burner, there is a fear that an excessive elongation difference or thermal stress would be generated.

Furthermore, since it is impossible to provide a structure for supporting the furnace (i.e., back stays) midway of the one-piece type blow box, it is necessary to provide excessive support structures at upper and lower portions of the air blow box, resulting in a disadvantageous increase of the cost.

Since the atomizing fuel supply conduit for supplying the mixture of the pulverized fuel and the air into the furnace is branched into a plurality of passages by the distributor, the structure becomes complicated, and a large number of the pulverized fuel outlets are provided, which leads to the factor of further increasing the height of the air blow box.

Also, furthermore, the conventional pulverized coal burner suffers from the following problems. In order to reduce the NOx generation amount and to stabilize the ignition, it is most preferable to use a combination of the concentrated burners 06 and the weak burners 07 for attaining the rich and lean fuel distribution. However, for this reason, the height of the panel of the burners is increased, the durable service life is shortened, and the overall structure of the burners 04 is complicated by the increase of the number of dampers.

The structure of the distributor 03 for adjusting the rich and lean pulverized coal mixture 02 becomes complicated.

For those reasons, the manufacture, control, maintenance and the like are very troublesome, which leads of a factor to increasing the cost.

SUMMARY OF THE INVENTION

In view of the above-noted defects, an object of the present invention is to provide a pulverized fuel combustion burner which can stabilize ignition, reduce NOx and prevent the growth of clinker adhered to an inner surface of a flame maintaining plate.

Another object of the present invention is to provide a pulverized fuel burner in which a pulverized fuel concentration distribution is provided between a central portion of the burner conduit and the vicinity of the inner wall of the burner conduit to thereby enhance the ignition property.

Also, still another object of the invention is to provide a burner in which, in a pulverized fuel boiler or the like for combustion of the pulverized fuel having two kinds of concentration, the crack or break-down of the burner blow box due to a difference in thermal elongation between the burner blow-box and the boiler tubes is suppressed, and the arrangement of the pulverized fuel conduit is simplified.

In order to attain the above-described and other objects, there is provided a pulverized burner with a pulverized fuel conduit having a flame maintaining plate at a tip end portion in which a secondary combustion assist air flow path is formed around the pulverized fuel conduit and the flame maintaining plate. A rich/lean separator is provided within the tip end portion of the pulverized fuel conduit.

The rich/lean separator may comprise a rich/lean separator having a swirl vane.

In the pulverized burner, a cross-sectional shape of the rich/lean separator is gradually increased toward a downstream side in a flow direction and thereafter is gradually decreased, with an apex at an upstream side end located at a center of the pulverized fuel conduit.

In a pulverized burner, a cross-sectional shape of the rich/lean separator is gradually increased toward a downstream side in a flow direction and thereafter has a bottom surface perpendicular to an axis thereof with an apex at an upstream side end located at a center of the pulverized fuel conduit.

According to the invention, a plurality of fins may be disposed in the secondary combustion assist air flow path around the flame maintaining plate, and a plurality of slits are formed in the flame maintaining plate.

In the pulverized burner, each of the slits may be radially provided in the flame maintaining plate.

In the pulverized burner, each of the slits may be concentrically formed in the flame maintaining plate.

Considering the pulverized fuel flow flowing through the pulverized fuel conduit in the above constituted pulverized fuel combustion burner of the present invention, the pulverized fuel flow which mainly contributes to the ignition is the pulverized fuel flow surrounded by the recirculation flow of the flame maintaining inner surface, i.e., a pulverized fuel flow which is present in the leak edge region of the pulverized fuel conduit. The flame is propagated in the pulverized fuel flow which passes through the central portion with a delay to that flow. In the pulverized fuel burner according to the present invention, the rich/learn separator is provided in the tip end portion of the pulverized fuel conduit, and the pulverized fuel flow is collided with the rich/lean separator to impart a swirl force or an inertia to the pulverized fuel flow to positively collect the pulverized fuel at the inner circumferential surface of the pulverized fuel conduit. As a result, a mixture having a high concentration of the pulverized fuel is formed on the inner circumferential surface of the pulverized coal. The A/C of the flame maintaining plate inner surface is reduced, the ignition is stabilized and the NOx is reduced irrespective of the combustion load.

In a heavy oil burner that is usually used, slits for preventing the carbon sticking to the flame maintaining plate are radially provided close to the proximal end of the flame maintaining plate. However, in the case where this is applied to the pulverized coal burner without any change, the strength of the recirculation eddy of the inner surface of the flame maintaining plate is reduced to make the ignition unstable. The sticking force of the clinker in the pulverized coal burner is weak in comparison with the carbon of the heavy oil burner, and the amount of the sticking of the clinker to the proximal end portion of the flame maintaining plate is very small. For this reason, in the above-described pulverized fuel burner, the metal temperature of the flame maintaining plate is reduced by the cooling effect of the secondary air by each fin provided in the secondary air flow passage around the flame maintaining plate (to prevent combustion damage of the nozzle). On the other hand, the sticking of the clinker to the flame maintaining plate is suppressed by each slit provided in the flame maintaining plate to prevent the growth of the clinker.

According to the present invention, in order to overcome the problems inherent in the prior art, there is provided a pulverized fuel rich/lean separator which is provided at an axial portion of a pulverized fuel conduit in a pulverized fuel burner which terminates at a flat surface perpendicular to an axis after its cross-sectional shape is gradually enlarged along the flow and becomes parallel to a flow direction. A cutaway slit axially penetrates the rich/lean separator.

Since the pulverized fuel rich/lean separator is provided at an axial portion of a pulverized fuel conduit in a pulverized fuel burner, terminates at a flat surface perpendicular to an axis after its cross-sectional shape is gradually enlarged along the flow and becomes parallel to the flow direction, the mixture of the pulverized fuel and the air flowing through the pulverized fuel conduit is deflected to the outer peripheral portion. Thereafter, the air is gradually returned back to the central portion of the conduit, but the pulverized powder is hardly returned. Accordingly, a rich/lean distribution is formed in which the mixture is lean in the axial portion and is rich in the peripheral portion downstream of the rich/lean separator.

With respect to the pulverized fuel mixture thus formed, a mixture having a high concentration of the pulverized fuel is formed in the outside portion within the pulverized fuel conduit and a mixture having a low concentration of the pulverized fuel is formed in the central portion within the pulverized fuel conduit by the effect of the pulverized fuel rich/lean separator. Such a mixture is fed to the pulverized fuel nozzle. The mixture having the high concentration of the pulverized fuel is ignited uniformly around the pulverized fuel nozzle to form a good flame. Also, the mixture having the low concentration of the pulverized fuel is ignited and burnt by the transition flame caused by the peripheral flame. The rich/lean pulverized fuel mixture is thus formed so that a better combustion flame than that of the conventional apparatus may be obtained to increase the NOx recirculation region within the burner flame.

According to the present invention, since the cutaway slit penetrating along the axis is provided, the part of mixture is introduced into the slit and is caused to flow to the back surface of the rich/lean separator. Thus, the eddy generated in the back surface is weakened and the entrainment of the pulverized fuel is suppressed.

According to the invention, in order to overcome the above-noted defect inherent in the prior art, there is provided a burner for combustion of the mixture of the pulverized fuel and the air into the furnace, wherein a burner blow box is divided into a plurality of unit blow boxes in the vertical direction. The unit blow boxes are separated from each other. A rich/lean separator for separating a rich mixture and a lean mixture of the pulverized fuel concentration is disposed together with a diffuser in a pulverized fuel feed conduit for feeding the mixture.

It is preferable that the pulverized fuel combustion burner be provided at corner portions of a side surface of a furnace.

A side edge of a side sectional surface of the diffuser has a shape defined by a polygonal side or a smoothly curved line, and the pulverized fuel and the delivery air are passed through along the side edge of the diffuser so that a flow path sectional area of the pulverized fuel feed conduit is changed.

Furthermore, also, in the diffuser used in the burner according to the invention, it is possible to use, instead of the diffuser, or in combination with the above-described diffuser, at least one plate-like or vane-like guide vane or a swirler (or spinner) composed of two or more plate-and vane-like guide vanes.

Since the present invention is structured as described above, and the burner blow box is divided into the plurality of unit blow boxes in the vertical direction, a height of the unit blow boxes is considerably decreased, to one half in comparison with the height of the blow box which is not divided into the plurality of unit blow box. The thermal stress due to the difference in elongation between the boiler tubes and the burner blow box thereby considerably enhances the durability over ten times or more.

Also, because the thus divided unit blow boxes are separated from each other, it is possible to dispose the support structure (horizontal back stay) between the respective unit blow boxes to make it possible to attain the uniform support to reduce the necessary strength of the support structure.

Since a rich/lean separator means for separating the pulverized fuel mixture into the rich mixture and the lean mixture of the pulverized fuel concentration is disposed in the pulverized fuel conduit, the structure may be simple, and the number of the injection outlets for the pulverized fuel may be reduced to decrease the height of the blow box, reducing a cost.

Then, by providing the rich/lean separator and the diffuser in combination, it is possible to form an optimum rich/lean distribution in a cross section of injection within the furnace in any duct arrangement of the pulverized fuel feed conduit.

Furthermore, according to the present invention, in order to solve the conventional problems, there is provided a pulverized fuel burner comprising a pulverized fuel conduit for introducing a mixture of a pulverized fuel and air substantially upwardly vertically and deflecting the mixture at a bend portion to inject the mixture from a flat nozzle portion at an end. A combustion assist air nozzle feeds a combustion assist air to a periphery of the nozzle portion. The fuel burner comprises a pulverized fuel rich/lean separator which is provided at an axial portion of a horizontal portion of a pulverized fuel conduit in a pulverized fuel burner, and terminates at a flat surface perpendicular to the axis after its cross-sectional shape is gradually enlarged along a flow and becomes parallel to the flow direction. A cutaway slit axially penetrates the pulverized fuel rich/lean separator. A kicker block provided at an upper portion of an outlet of a bend portion of the pulverized fuel conduit has a surface slanted relative to the flow direction.

Since the present invention has the above-described structure and the kicker block is provided at the upper portion of the outlet of the bend portion of the pulverized fuel conduit and has the surface slanted relative to the flow direction, the strong swirl flow generated downstream of the bend portion outlet is suppressed, attaining a uniform pulverized fuel mixture in the concentration and introducing it into the rich/lean separator.

The rich/lean separator is provided at an axial portion of a horizontal portion of the pulverized fuel conduit in the pulverized fuel burner, terminates at the flat surface perpendicular to the axis after its cross-sectional shape is gradually enlarged along the flow and becomes parallel to the flow direction, and the pulverized coal mixture that has collided with the rich/lean separator is divided up and down and right and left to be collected in the vicinity of the inner circumferential wall of the pulverized fuel conduit. On the other hand, the air is returned back to the axial portion of the pulverized fuel conduit downstream of the rich/lean separator. Accordingly, the pulverized fuel concentration is such that it is high in the outside (close to the conduit wall) of the pulverized fuel tube and low in the central portion of the conduit.

Since the cutaway slit is provided in the rich/lean separator, a part of the pulverized fuel mixture penetrates the cutaway slit to obviate the eddy caused by the negative pressure generated on the back surface of the rich/lean separator to accelerate the rich/lean separation effect.

Thus, it is possible to form the pulverized fuel mixture having the high concentration at the outside and the low concentration at the central portion within a single pulverized fuel conduit.

DESCRIPTION OF THE PREFERRED EMBODIMENTS

The present invention will now be described with reference to the accompanying drawings.

(First Embodiment)

Figure 1:
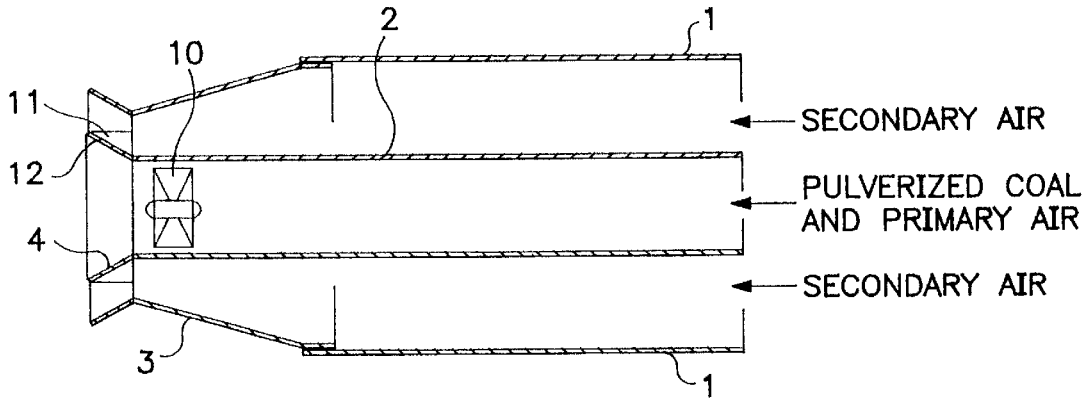
FIG. 1 is a longitudinal sectional view showing a first embodiment of a pulverized fuel burner according to the invention.
Figure 2:
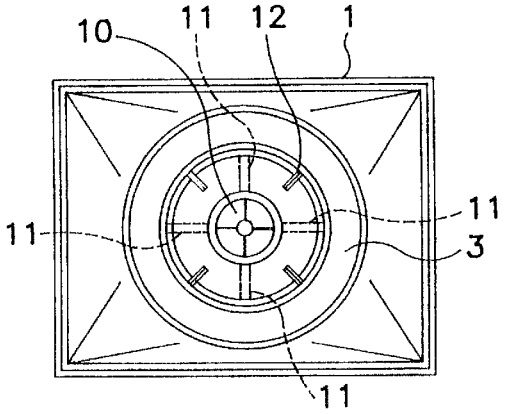
FIG. 2 is a front view of the pulverized coal burner.

A pulverized coal burner as a pulverized fuel combustion burner, according to a first embodiment of the invention will now be explained with reference to FIGS. 1 and 2. Reference numeral 1 denotes an air blow box, numeral 2 denotes a pulverized coal conduit provided in a central portion of the air blow box 1, numeral 3 denotes a secondary air nozzle mounted at a front end portion of the air blow box 1, and numeral 4 denotes a flame maintaining plate mounted at a front end portion of the pulverized coal conduit 2. A passage (for the pulverized coal plus primary air) is formed within the pulverized coal conduit 2, and a passage (for secondary air) is formed between the air blow box 1 and the secondary air nozzle 3, and the pulverized coal conduit 2 and the flame maintaining plate 4.

Reference numeral 10 denotes a rich and lean separator having swivel blades. The rich and lean separator is disposed in the tip end portion of the pulverized coal conduit 2. Reference numeral 11 denotes a plurality of fins provided on the outer surface of the flame maintaining plate 4. Reference numeral 12 denotes a plurality of slits provided radially in the flame maintaining plate 4.

The operation of the pulverized coal burner shown in FIGS. 1 and 2 will now be described in more detail.

Of the pulverized coal flow flowing through the pulverized coal conduit 2, the pulverized coal flow that mainly contributes to the ignition is a pulverized coal flow surrounded by a recirculation flow on the inner surface of the flame retaining plate 4, i.e., a pulverized coal flow that is present in a leakage edge region of the pulverized coal conduit 2. The flame propagates the pulverized coal flow flowing through the central portion with a time lag relative to the pulverized coal flow that is present in the leakage edge region. The pulverized coal burner is provided with the rich and lean separator 10 having swivel blades within the tip end portion of the pulverized coal conduit 2. The pulverized coal flow is collided with this to impart a swivel force or an inertia to the pulverized coal flow to positively collect the pulverized coal to the inner circumferential side of the pulverized coal conduit 2 and to form a mixture having a high pulverized coal concentration on the inner circumferential side of the pulverized coal conduit 2. As a result, the A/C of the inner surfaces of the flame maintaining plate 4 is rendered to be low to stabilize ignition irrespective of the combustion load to reduce NOx.

In a heavy oil burner that is usually used, slits for preventing the carbon sticking to the flame maintaining plate are radially provided close to the proximal end of the flame maintaining plate. However, in the case where this is applied to the pulverized coal burner without any change, the strength of the recirculation eddy of the inner surface of the flame maintaining plate is reduced, making the ignition unstable. The sticking force of the clinker in the pulverized coal burner is weak in comparison with the carbon of the heavy oil burner, and amount of the sticking of the clinker to the proximal end portion of the flame maintaining plate is very small. For this reason, in the above-described pulverized coal burner, the metal temperature of the flame maintaining plate 4 is reduced by the cooling effect of the secondary air by each fin 11 provided in the secondary air flow passage around the flame maintaining plate 4 (to prevent combustion damage to the nozzle). On the other hand, the sticking of the clinker to the flame maintaining plate 4 is suppressed by each slit 12 provided in the flame maintaining plate 4 to prevent the growth of the clinker.

(Second Embodiment)

Figure 3:
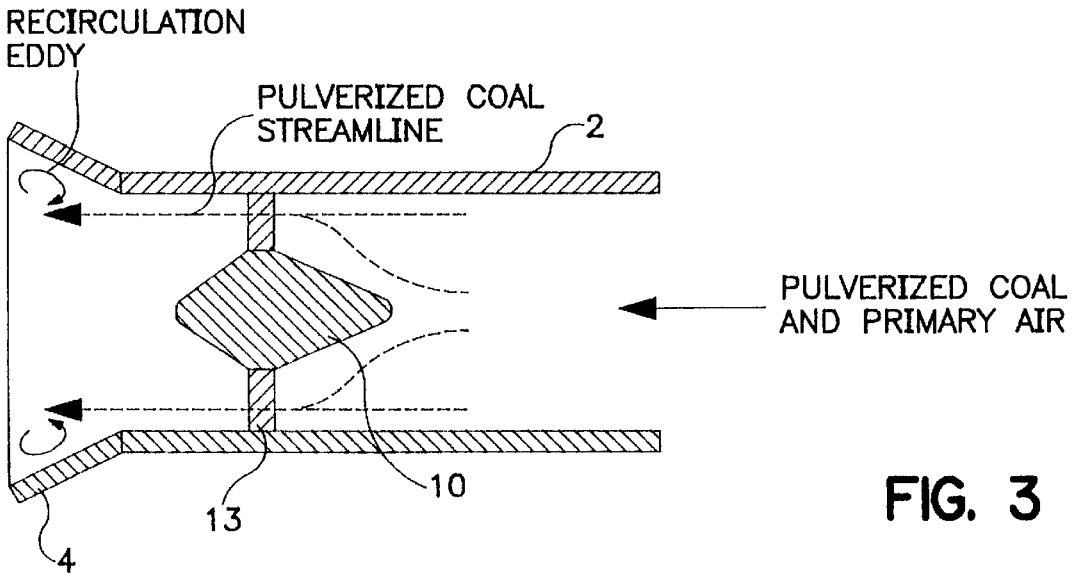
FIG. 3 is a longitudinal view showing a second embodiment of a pulverized fuel burner according to the invention.
Figure 4:
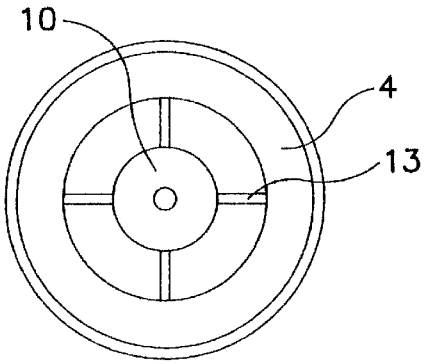
FIG. 4 is a front view of the pulverized coal burner of FIG. 3.

FIGS. 3 and 4 show a second embodiment in which a rich and lean separator 10 is shaped so that a cross-section is gradually increased toward the downstream side and the decreased toward the downstream side. An apex is located at center of a pulverized coal conduit 2 and an end portion is toward the upstream side. Reference numeral 13 denotes a support plate of the rich and lean separator 10.

In the rich and lean separator 10, the pulverized coal is positively collected on the inner circumferential surface of the pulverized coal conduit 2 by directly colliding the pulverized coal flow or curving the stream line of the pulverized coal flow. Thus a mixture having a high concentration of the pulverized coal is formed on the inner circumferential surface of the pulverized coal conduit 2 to thereby reduce the A/C ratio on the inner surface of the flame maintaining plate 4 and to stabilize the ignition irrespective of the combustion load to reduce NOx.

(Third Embodiment)

Figure 5:
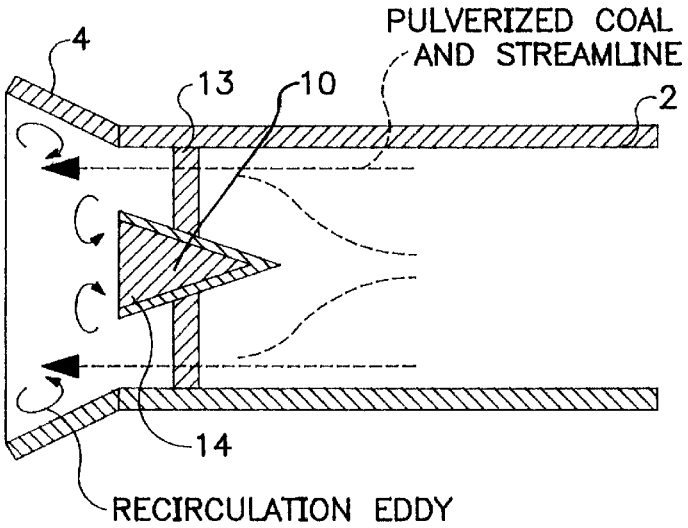
FIG. 5 is a longitudinal sectional view showing a third embodiment of a pulverized fuel burner according to the invention.
Figure 6:
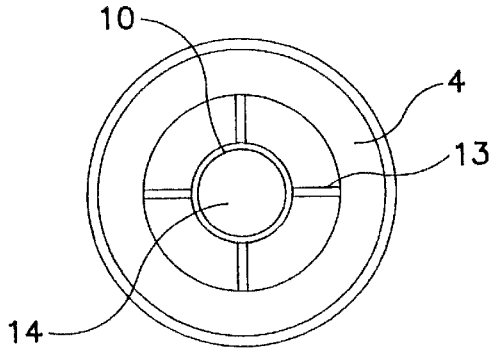
FIG. 6 is a front view of the pulverized coal burner of FIG. 5.

FIGS. 5 and 6 show a third embodiment in which a rich and lean separator 10 is shaped so that a cross-section is gradually increased toward the downstream side. A bottom surface is perpendicular to a center axis with an apex located at a center of a pulverized coal conduit 2 with an end portion directed toward the upstream side. Reference numeral 13 denotes a support plate of the rich and lean separator 10. Reference numeral 14 denotes a refractory member filled in the rich and lean separator 10.

In the rich and lean separator 10, the pulverized coal is positively collected on the inner circumferential surface of the pulverized coal conduit 2 by directly colliding the pulverized coal flow or curving the stream line of the pulverized coal flow. Thus a mixture having a high concentration of the pulverized coal is formed on the inner circumferential surface of the pulverized coal conduit 2 to thereby reduce the A/C ratio on the inner surface of the flame maintaining plate 4 and to stabilize the ignition irrespective of the combustion load to reduce NOx.

In this case, the downstream surface (flat surface 14 of the refractory member) of the rich and lean separator 10 is perpendicular to the center axis and is directly subjected to the radiation heat of the burner flame to be kept at a high temperature. The recirculation eddy formed thereat has a flame maintaining function to keep uniform the flame surface in the cross-sectional direction to further enhance the ignition.

(Fourth Embodiment)

Figure 7:
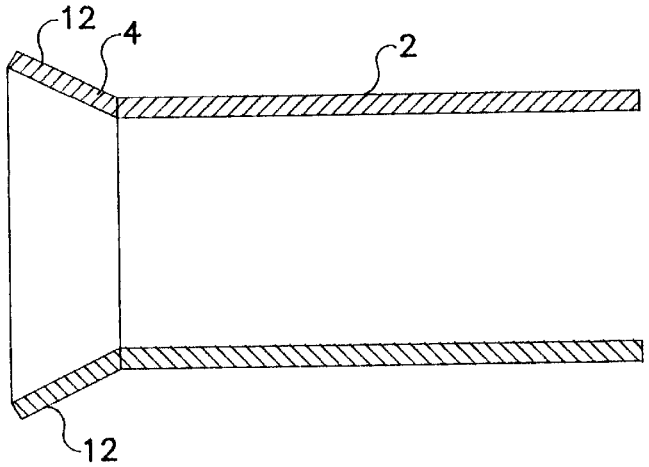
FIG. 7 is a longitudinal sectional view showing a fourth embodiment of a pulverized fuel burner according to the invention.
Figure 8:
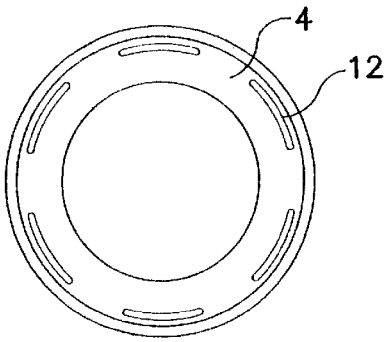
FIG. 8 is a front view of the pulverized coal burner of FIG. 7.

FIGS. 7 and 8 show a fourth embodiment in which each slit 12 is formed in a concentric manner in the flame maintaining plate 4. Also in this embodiment, a plurality of fins 11 are provided in the secondary air flow path around the flame maintaining plate 4. In the same manner as in the first embodiment shown in FIGS. 1 and 2, the metal temperature of the flame maintaining plate 4 is lowered by the cooling effect of the secondary air through the respective fins 11 (for the purpose of the combustion damage of the nozzle) to thereby suppress the adhesion of the clinker to the flame maintaining plate 4 by the respective slits 12 formed in the flame maintaining plate 4.

(Fifth Embodiment)

Figure 9A:
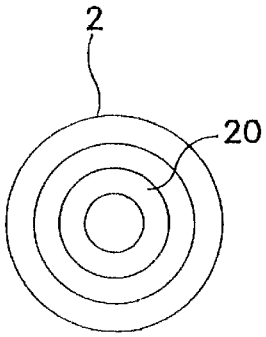
FIG. 9 is a longitudinal sectional view and a frontal view showing a structure of a pulverized coal burner to which a pulverized coal rich/lean separator according to a fifth embodiment is applied.
Figure 9B:
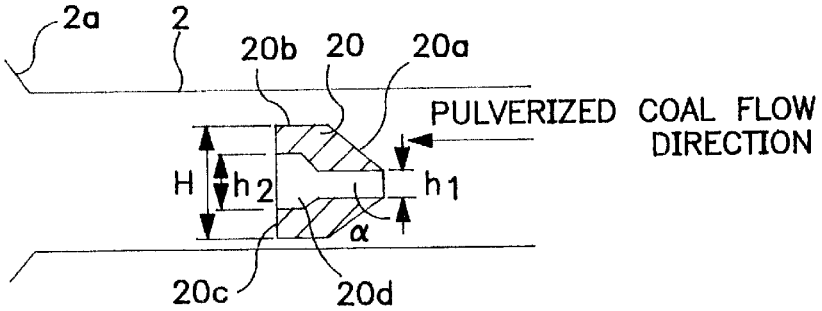

FIG. 9 is a longitudinal view showing a structure of a pulverized coal burner to which is applied a pulverized coal rich/lean separator according to a fifth embodiment. The pulverized coal rich/lean separator 20 is disposed on the center axis of the pulverized coal conduit 2 within the burner. The shape of the pulverized coal rich/lean separator 20 is such that its front portion 20*a* is sharpened in a conical shape and a cylindrical portion 20*b* is continuous with the conical shape. Namely, the cross-section of the front portion 20*a* is gradually increased along with the flow and thereafter the outer periphery thereof is in parallel with the flow to terminate at a flat surface 20*c* perpendicular to the center axis. Then, a cutaway slit 20*d* which penetrates the portion around the center axis is provided.

The mixture of the pulverized coal and the air is deflected toward the outer peripheral portion by the pulverized coal rich/lean separator 20 provided in the axial portion of the pulverized coal conduit 2. Thereafter, the air is gradually returned back to the central axial portion, but the pulverized coal is hardly returned back to the central axial portion. As a result, the rich/lean distribution is formed in the downstream of the rich/lean separator in which the concentration at the central portion is lean and the concentration at the peripheral portion is rich. A part of the pulverized coal mixture is introduced into the slit 20*d* and discharged to the back surface 20*c*. Thus, the eddy generated at the back surface of the rich/lean separator 20 is weakened to thereby suppress the entrainment of the pulverized coal and to maintain a uniform flow rate distribution.

With respect to the pulverized coal mixture thus formed, a mixture having a high concentration of the pulverized coal is formed in the outside portion within the pulverized coal conduit 2 and a mixture having a low concentration of the pulverized coal is formed in the central portion within the pulverized coal conduit 2 by the effect of the pulverized coal rich/lean separator. Such a mixture is fed to the pulverized coal nozzle 2*a*. The mixture having the high concentration of the pulverized coal is ignited uniformly around the pulverized coal nozzle 2*a* to form a good flame. Also, the mixture having the low concentration of the pulverized coal is ignited and burnt by the transition flame caused by the peripheral flame. The rich/lean pulverized coal mixture is thus formed so that a better combustion flame than that of the conventional apparatus may be obtained to increase the NOx recirculation region within the burner flame.

In order to stabilize a combustion of the pulverized coal, it is necessary to form the effective concentration distribution and to form a uniform flow rate distribution with the pulverized coal nozzle 2*a*. In order to obtain this pulverized coal concentration distribution, it is preferable that an angle $\alpha$ of the front portion 20*a* of the pulverized coal rich/lean separator 20 be in the range of 10° to 60°, and more preferably in the range of 35° to 45°. Also, the cutaway slit 20*d* is effectively used to make uniform the flow rate distribution with the pulverized coal nozzle 2*a*. A dimension of the cutaway slit 20*d* is determined so that $H/h_1$ is in the range of 3 to 5 in order to introduce only the air into the interior of the slit and expel the pulverized coal to the outer peripheral portion. As described above, the pulverized coal separated to the outer periphery of the pulverized coal rich/lean separator 20 tends to be entrained by the negative pressure of the back surface 20*c* of the separator. However, in the embodiment, the air is injected from the cutaway slit 20*d* to the back surface 20*c* of the separator to hereby prevent the entrainment. Also, by selecting $H/h_2$ in the range of 1.1 to 3, it is possible to keep the flow rate distribution uniform in the burner jet port 2*a*.

(Sixth Embodiment)

Figure 10A:
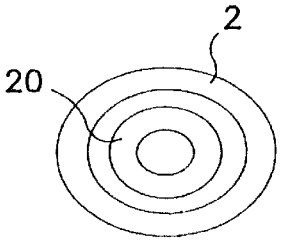
FIG. 10 is a longitudinal sectional view and a frontal view showing a structure of a pulverized coal burner to which a pulverized coal rich/lean separator according to a sixth embodiment is applied.
Figure 10B:
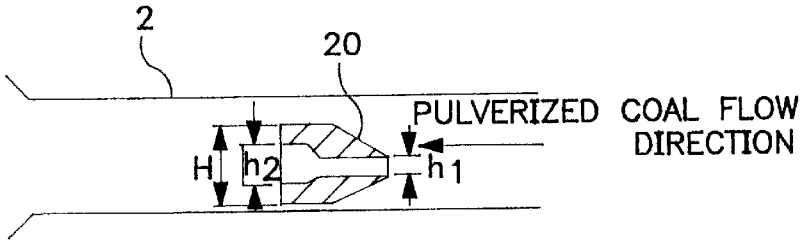

FIG. 10 is a longitudinal view showing a structure of the pulverized coal burner to which is applied is a pulverized coal rich/lean separator according to a sixth embodiment. Even if the cross-section of the burner is elliptical as shown in FIG. 10, it is possible to attain the object in the same manner in the range of $H/h_1$ and $H/h_2$ as discussed in conjunction with the fifth embodiment.

(Seventh Embodiment)

Figure 11A:
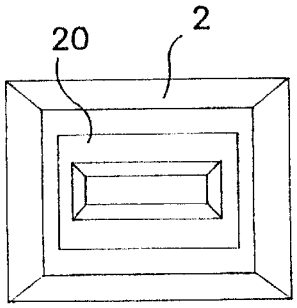
FIG. 11 is a longitudinal sectional view and a frontal view showing a structure of a pulverized coal burner to which a pulverized coal rich/lean separator according to a seventh embodiment is applied.
Figure 11B:
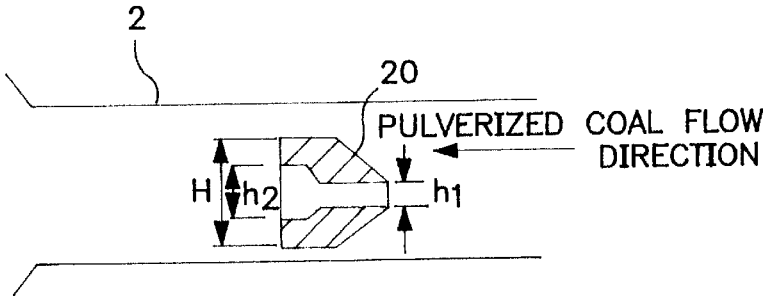
Figure 12A:
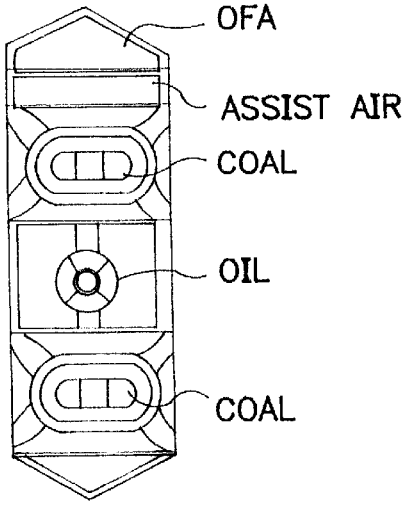
FIG. 12 is a longitudinal sectional view and a frontal view showing a structure of a pulverized coal burner to which a pulverized coal rich/lean separator according to an eighth embodiment is applied.
Figure 12B:
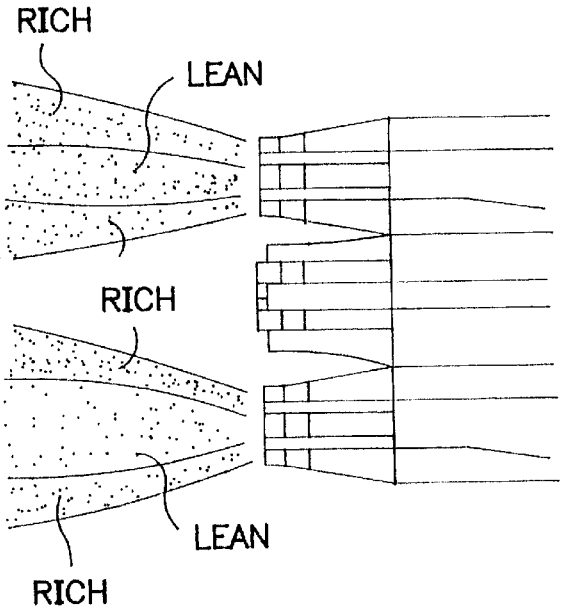
Figure 12C:
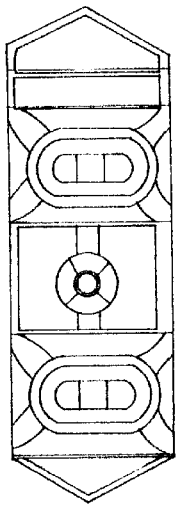
Figure 12D:
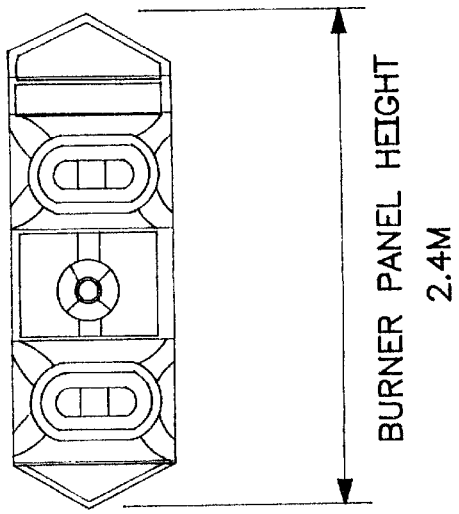

FIG. 11 is a longitudinal view showing a structure of the pulverized coal burner to which is applied is a pulverized coal rich/lean separator according to a seventh embodiment. Even if the cross-section of the burner is rectangular as shown in FIG. 11, it is possible to attain the object in the same manner in the range of $H/h_1$ and $H/h_2$ as discussed in conjunction with the fifth embodiment.

(Eighth Embodiment)

Figure 13:
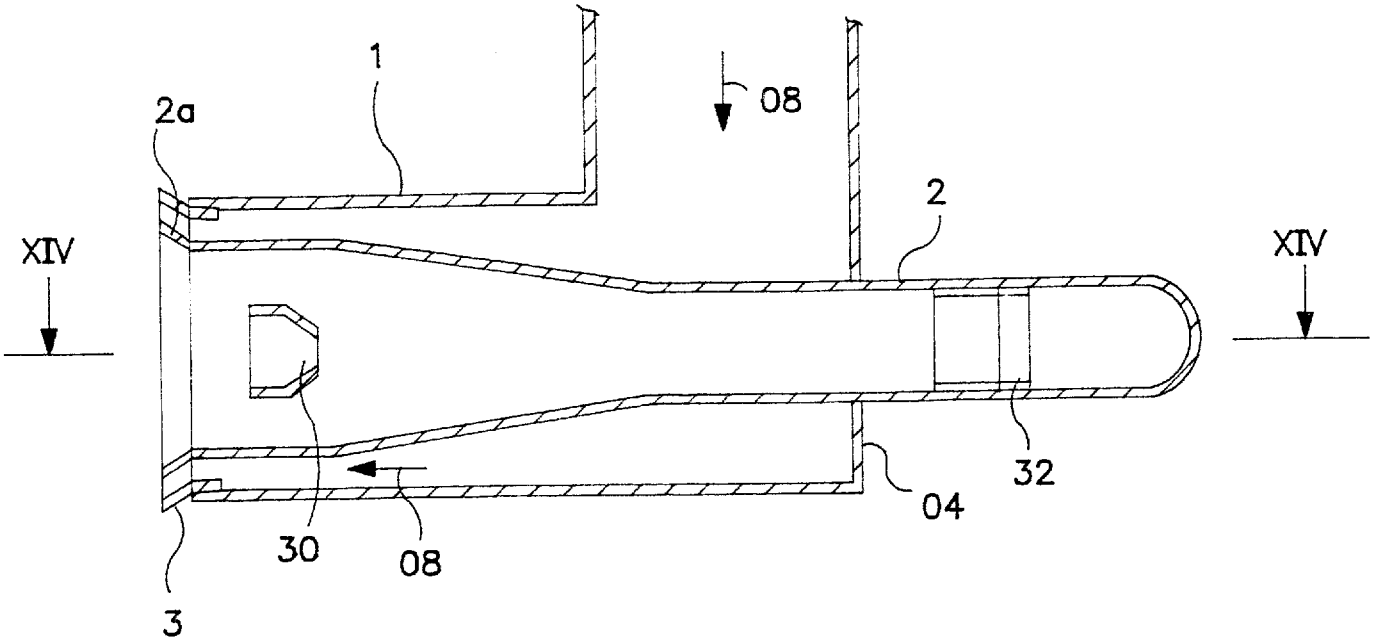
FIG. 13 is a horizontal sectional view (taken along line XIII—XIII of FIG. 14) showing a burner of one block.
Figure 14A:
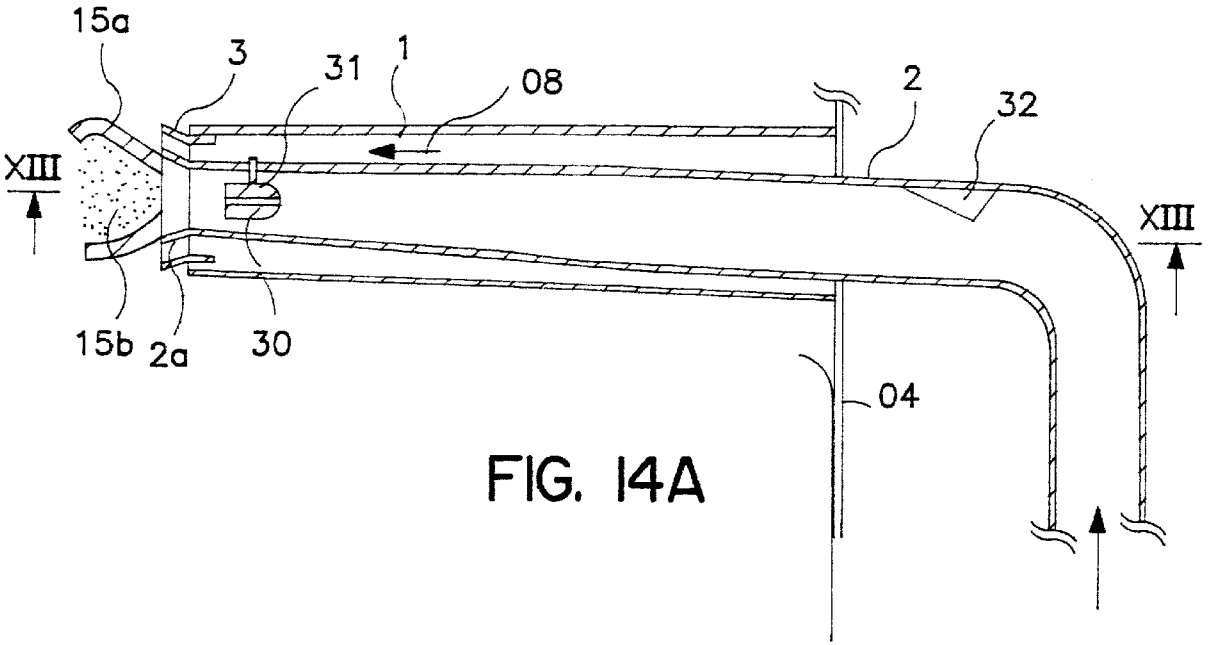
FIG. 14 is a longitudinal sectional view taken along line XIV—XIV of FIG. 13.
Figure 14B:
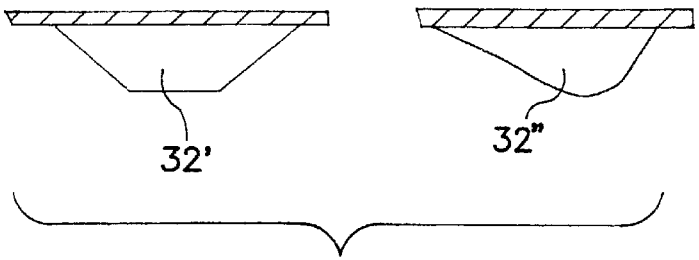

FIG. 12 includes frontal views showing an overall arrangement and a longitudinal sectional view showing a burner end portion of a pulverized coal burner in accordance with an eighth embodiment. FIG. 13 is a horizontal sectional view (taken along the line XIII—XIII of FIG. 14) showing a burner of one block out of FIG. 12. FIG. 14 is a longitudinal sectional view taken along the line XIV—XIV of FIG. 13.

Figure 15:
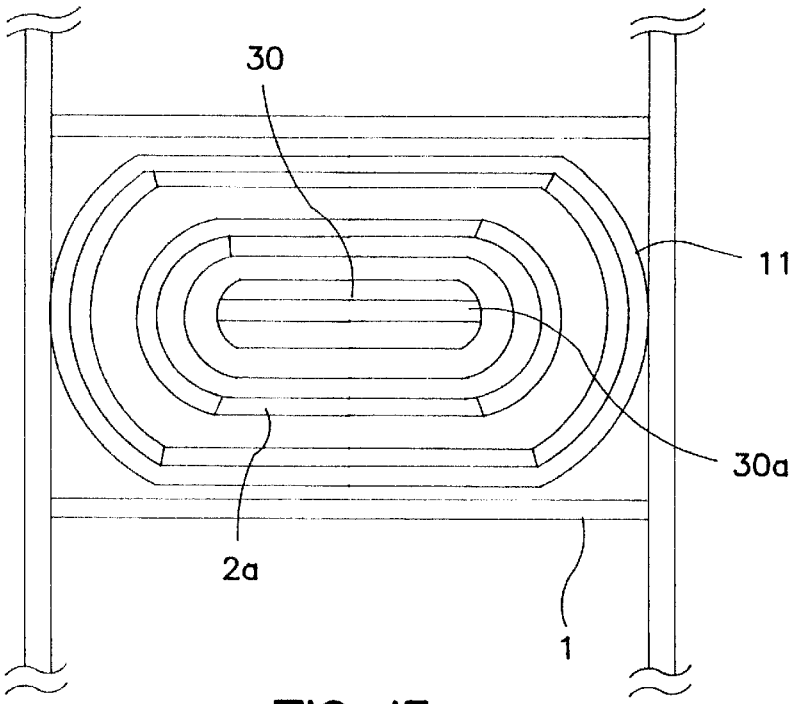
FIG. 15 is a frontal view of FIG. 14.

FIG. 15 is a frontal view of FIG. 14. In these drawings, the same components or members as those described in conjunction with FIGS. 30 to 33 are indicated by the same reference numerals and will not be explained again to avoid repetition. In this embodiment, reference numeral 32 denotes a kicker block (diffuser), numeral 30 denotes a rich/lean separator, character 30*a* denotes a cutaway slit of the rich/lean separator 30, characters 15*a* and 15*b* denote flame, and numeral 31 denotes a fastening member of the rich/lean separator.

In this embodiment as shown in FIG. 12, a burner blow box is divided into a plurality (three in the embodiment) of unit blow boxes in the vertical direction. The plurality of unit blow boxes are separated from each other. Namely, the blow box according to this embodiment is not of the integral type which is continuous in the vertical direction, but is separated into a plurality of discontinuous ones. Accordingly, height of the unit blow boxes is considerably decreased to decrease thermal stress caused by a difference in elongation between the boiler tubes and the burner blow boxes to thereby considerably enhance the durability. Also, by arranging a support structure (horizontal back stay) between the respective divided unit blow boxes, it is possible to attain a uniform support to reduce the necessary mechanical strength of the support structure.

As shown in FIGS. 13 to 15, the kicker block 32 is provided at an upper portion of a bend portion outlet of the pulverized coal conduit 2 for feeding the pulverized mixture. The rich/lean separator 30 is provided immediately upstream of the inlet of the pulverized coal nozzle 2*a*. Incidentally, the kicker block 32 may be formed into block 32' defined by sides of a polygonal shape, or block 32" defined by smoothly curved lines.

The pulverized coal delivered by the primary air is concentrated on the upper portion by the strong centrifugal force at the bend portion of the pulverized coal conduit 2. However, it is again diffused by the kicker block 32 provided in the upper portion of the outlet of the bend portion and is introduced into the rich/lean separator 30. The mixture (mixture of the pulverized coal and the primary air) having a high concentration of the pulverized coal is formed in the outer portion and the mixture having a low concentration of the pulverized coal is formed in the central portion within the pulverized coal conduit 2 by the effect of the rich/lean separator 30. The mixture is fed to the pulverized coal nozzle 2*a*. The mixture having the high concentration of the pulverized coal is ignited uniformly around the pulverized coal nozzle 2*a* to form a good flame 15*a*. Also, the mixture having the low concentration of the pulverized coal is ignited and burnt by the transition flame caused by the peripheral flame to form a flame 15*b*. The rich/lean pulverized coal mixture is thus formed so that a better combustion flame than that of the conventional apparatus may be obtained to increase the NOx recirculation region within the burner flame.

Figure 16A:
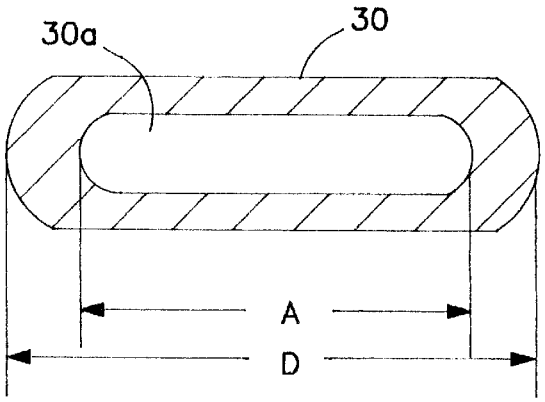
FIG. 16 is a view showing a shape and a dimension of a core type rich/lean separator.
Figure 16B:
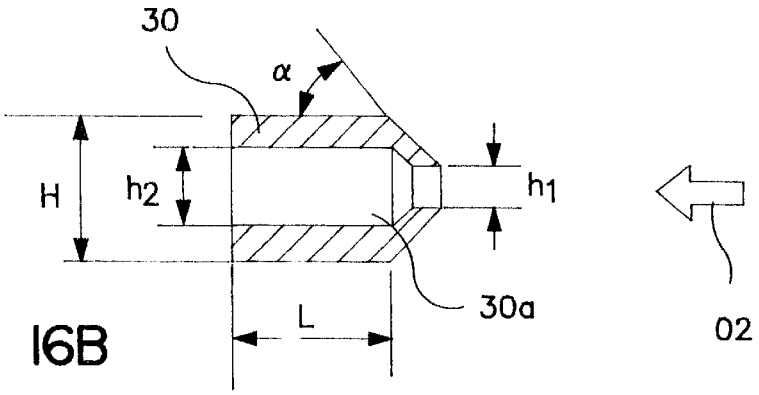
Figure 17:
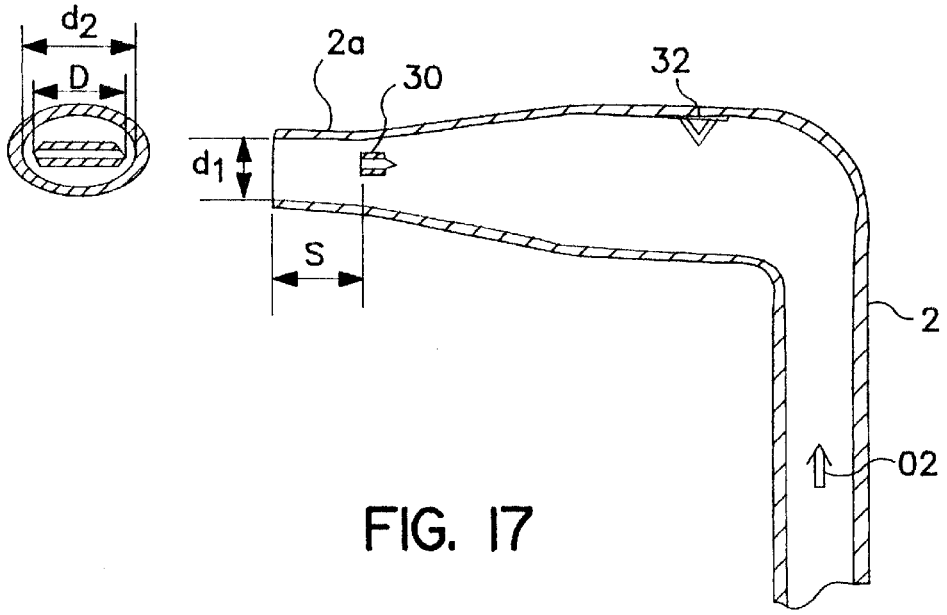
FIG. 17 is a view showing dimensions of a pulverized coal nozzle a set position of the rich/lean separator and a diffuser.

The dimensions of the rich/lean separator 30 will be explained. As shown in FIG. 16, a width of the rich/lean separator 30 is represented by D, a length of the straight conduit portion is represented by L, a height of the rear surface is represented by H, a width of cutaway slit 30*a* is represented by A, a height of an inlet portion is represented by $h_1$, a height of an outlet portion is represented by $h_2$, and a slant angle of the cross section relative to the flow direction is represented by $\alpha$. Also, as shown in FIG. 17, a height of the pulverized coal nozzle 2*a* is represented by $d_1$, a width thereof is represented by $d_2$ and a distance from the nozzle tip end to the rich/lean separator 30 is represented by S.

Figure 18:
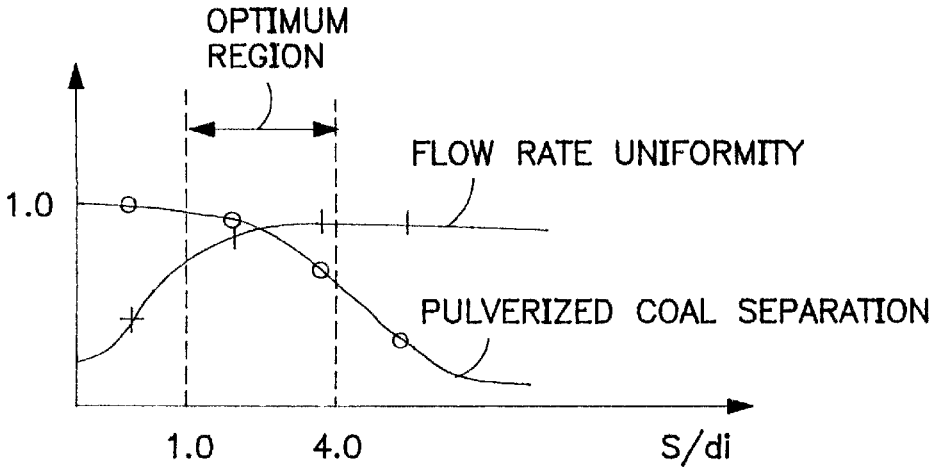
FIG. 18 is a graph showing a relationship between the set position of the rich/lean separator, pulverized coal separation and flow rate uniformity.

With respect to setting the position of the rich/lean separator 30, it is preferable that $S/d_1$ be in the range of 1 to 4, more preferably in the range of 2 to 3, and most preferably at 3. At the outlet cross-section of the pulverized coal conduit 2, it is ideal that the injection flow rate be kept uniform and only the rich/lean distribution of the pulverized coal is attained. The smaller $S/d_1$, the more the rich/lean distribution will occur. However, the flow rate distribution may be kept non-uniform. Inversely, the greater $S/d_1$, the more the flow rate may be kept uniform. However, the rich/lean distribution will not occur; the state is shown in FIG. 18, and it is understood that the range of $S/d_1$=1 to 4 is an optimum region.

Figure 19:
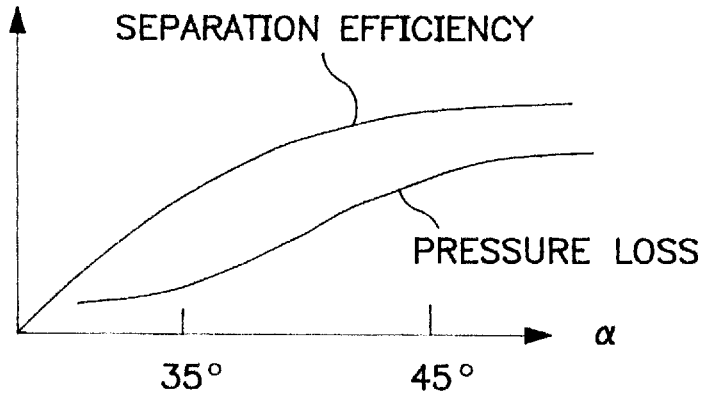
FIG. 19 is a graph showing a relationship among a cross section slant angle of the rich/lean separator, separation efficiency and pressure loss.

It is preferable that the slant angle $\alpha$ of the cross section relative to the flow direction be in the range of 10° to 60°, and more preferably in the range of 35° to 45°. The larger the angle $\alpha$, the greater the separation efficiency will become, but the greater the pressure loss will become also. This condition is shown in FIG. 19. In consideration of the limit of the pressure loss, the range of 35° to 45° is an optimum region. It is most preferable to set the angle at 45°.

Figure 20:
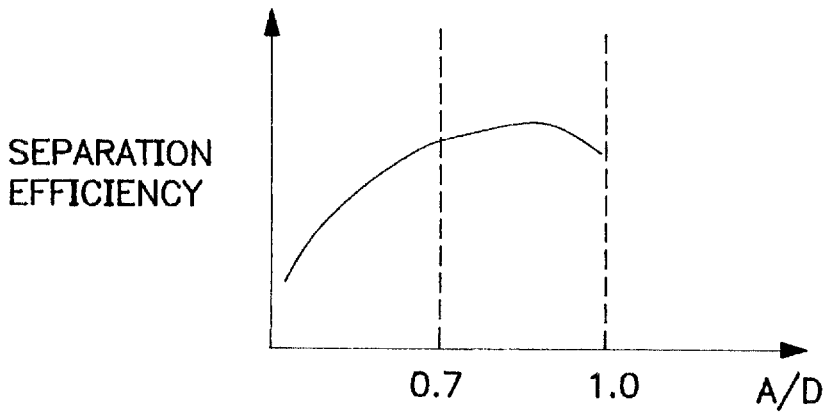
FIG. 20 is a graph showing a relationship between a width of a cutaway slit of the rich/lean separator and the separation efficiency.

Also, the relationship between the width D of the rich/lean separator and the width A of the cutaway slit is preferably set to A/D=0.7 to 1.0. The optimum value A/D is 0.9. When the A/D is small, the eddy is generated on the side surface of the rich/lean separator and the amount of the entrainment of the coal is increased. If the A/D is about 1.0, that is, the rich/lean separator is divided into upper and lower portions, the ratio is at a maximum. However, as shown in FIG. 20, the separation efficiency is not enhanced.

Figure 21:
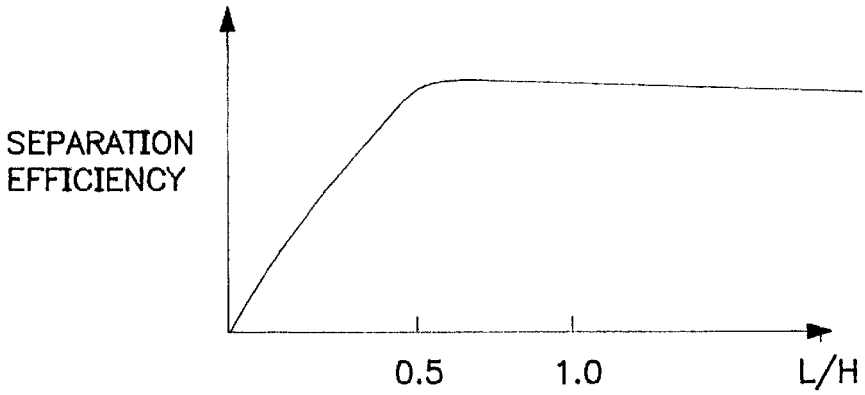
FIG. 21 is a graph showing a ratio of a back surface height to a straight portion length of the rich/lean separator and the separation efficiency.

Preferably, the relationship between the back surface height H and the straight portion length L of the rich/lean separator is selected in the range of L/H=0.5 to 1.0. The optimum value is L/H=0.5. As the height H is decreased, the eddy of the downstream portion of the rich/lean separator is enlarged to increase the entrainment of the coal. As shown in FIG. 21, the separation efficiency is reduced. When the L/H is increased to some extent, the volume is increased without any change of the separation efficiency. Accordingly, the optimum region is present.

In addition, preferably, the relationship $D/d_2$ between the width D of the rich/lean separator 30 and the lateral width $d_2$ of the pulverized coal nozzle 2*a* is selected in the range of 0.9 to 1. Also, the relationship between the heights h, and h of the cutaway slit 30*a* and the height H of the downstream surface of the rich/lean separator 30 is $h_2/H=0.4$ and $h_1/H=0.2$.

Figure 22A:
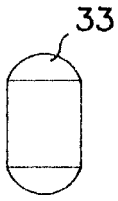
FIG. 22 is a view showing an example of a side kicker.
Figure 22B:
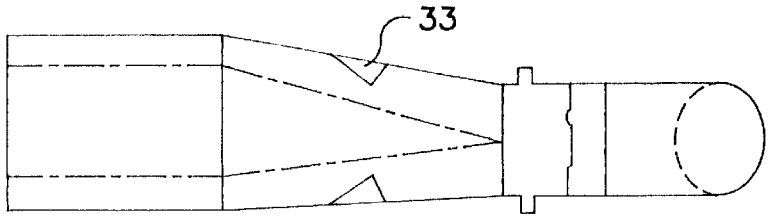
Figure 22C:
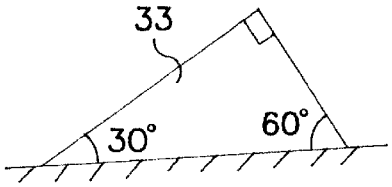
Figure 23:
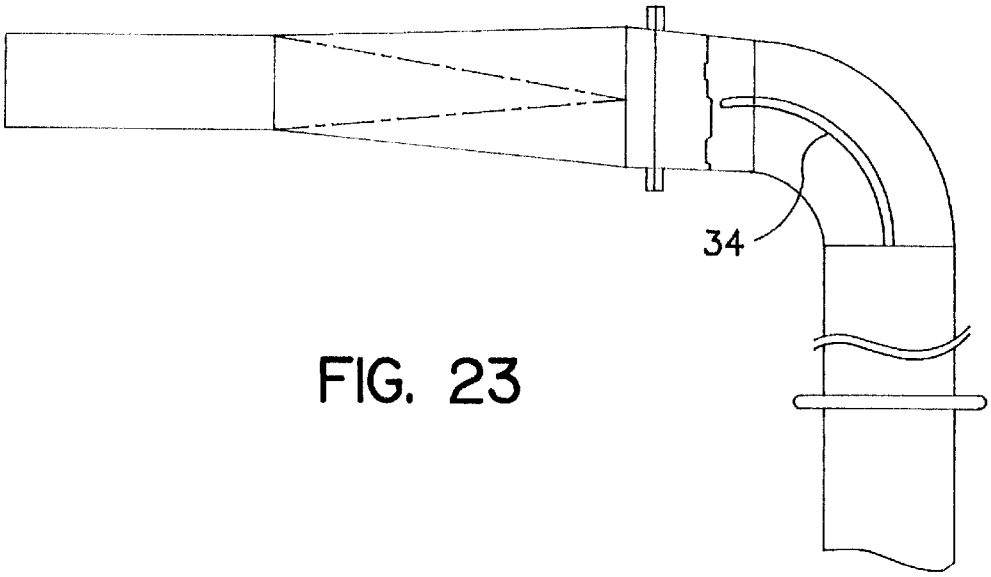
FIG. 23 is a view showing an example of a guide vane.
Figure 24A:
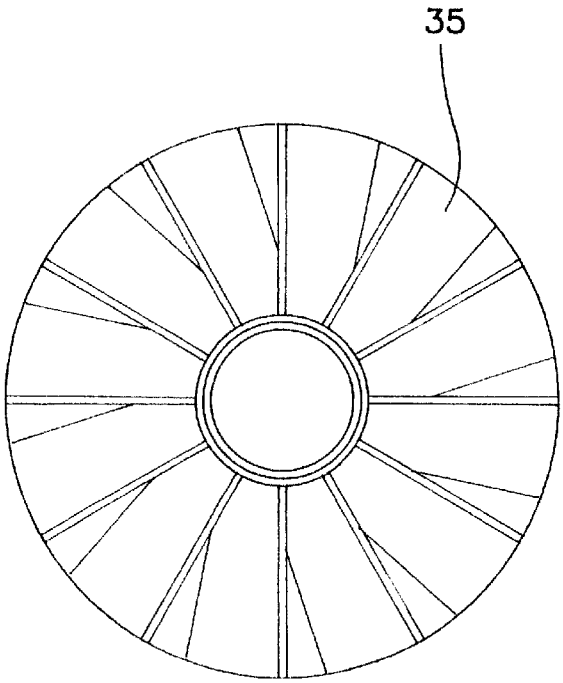
FIG. 24 is a view showing an example of a swirler (spinner)
Figure 24B:
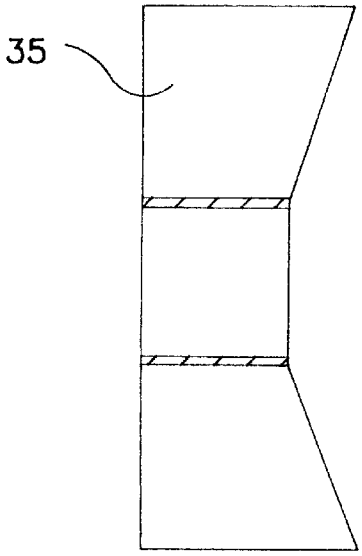

In the above-described embodiment, the kicker block 32 of the upper portion of the pulverized coal conduit bend portion outlet is used as a diffuser and the rich/lean separator 30 of the pulverized coal nozzle inlet is used as the rich/lean separator. In addition, it is possible to use, in combination, a side kicker 33 provided in the both side walls downstream of the bend portion of the pulverized coal conduit 2 as shown in FIG. 22, a guide vane 34 as shown in FIG. 23, a swirler (spinner) 35 as shown in FIG. 24 and the like, as a diffuser.

The separation effect of the rich/lean separator will be explained. Both the pulverized powder and the air are deflected to the outer peripheral portion by the wedge-shape formed in the central portion of the pulverized coal conduit 2. Thereafter, the air is gradually returned toward the central portion but the pulverized powder hardly returns. Accordingly, a rich/lean distribution is formed in which the concentration of the central portion is lean and the concentration of the outer peripheral portion is rich in the downstream flow of the rich/lean separator. Next, the diffusion effect of the diffuser will be explained. First of all, the kicker block 32 of the bend portion causes the pulverized powder deflected outwardly to collide with the kicker to be returned toward the central portion. Also, the side kicker 33 causes the pulverized powder deflected to the side portions to collide with the kicker to be returned back to the central portion. Furthermore, the guide vane 34 divides the pulverized coal feed conduit and prevents the pulverized powder from being deflected by the centrifugal portion at the bend portion. Then, the swirler 35 imparts a swirl motion to the pulverized powder deflected outwardly at the bend portion and diffuses the concentration distribution. According to the present invention, the rich/lean separator and the diffuser are combined with each other so that the optimum rich/lean distribution may be formed in the injection cross-section within the furnace of the pulverized coal feed conduit.

In the burner according to the eighth embodiment, the rich/lean separator is provided in combination with the diffuser to suppress the effect of the unnecessary concentration distribution generated by the effect of the centrifugal force at the bend portion of the pulverized coal-like fuel feed conduit and to form the concentration distribution by which the optimum combustion flame may be formed. For example, among the embodiments of the invention, in the example in which the rich/lean separator and the kicker as the diffuser are combined, the rich/lean distribution in the outlet surface of the nozzle may be formed so that the concentration on the outer peripheral side of the nozzle is uniformly formed at a desired concentration over a wide range one to four times of the concentration of the central portion of the nozzle. However, in the case where the rich/lean separator is solely used without combination with the diffuser, since the unnecessary concentration distribution is generated by the effect of the centrifugal force at the bend portion of the pulverized fuel feed conduit, it is difficult to uniformly form the desired rich/lean distribution.

According to the present invention, the ignition property of the burner is enhanced and the amount of NOx may be reduced.

A single burner may be used by providing the rich/lean separator in the pulverized coal conduit instead of the conventional two burners, i.e., a high concentration burner and a weak burner. The number of the burners may be reduced and the system may be made compact. Accordingly, the height of the burner panel is reduced to half the height of the conventional burner panel. The service life thereof may be prolonged. A complicated pulverized coal distributer may be dispensed with. The overall burner may be simplified and the cost may be reduced.

Also, a diffuser such as a kicker block is provided at the upper portion of the bend outlet of the pulverized coal conduit, and is combined with the above-described rich/lean separator so that the rich/lean separation effect of the pulverized coal mixture may be accelerated. Furthermore, by the flat pulverized coal nozzle, it is possible to form an extremely excellent ignition and a flame which is stable. Also, the NOx reduction region is increased in the burner flame.

(Ninth Embodiment)

Figure 25:
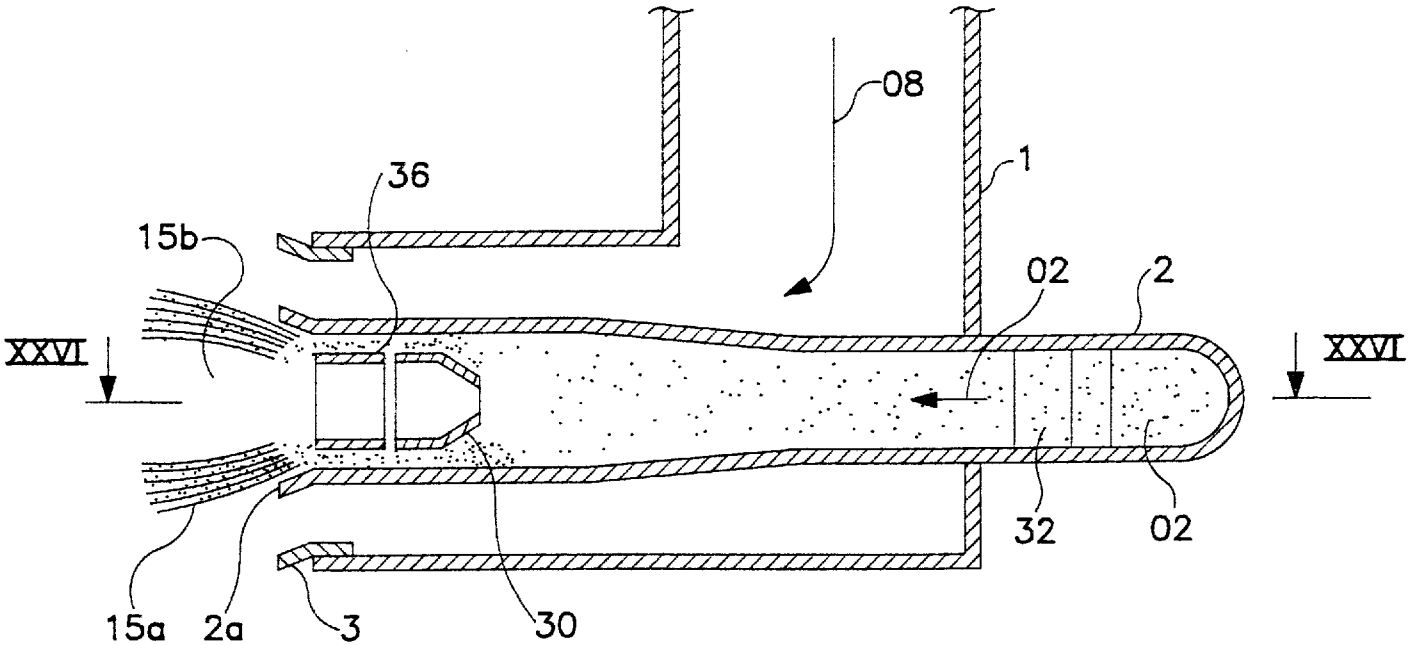
FIG. 25 is a horizontal sectional view (sectional view taken along the line XXV—XXV of FIG. 26) showing a ninth embodiment of the invention.
Figure 26:
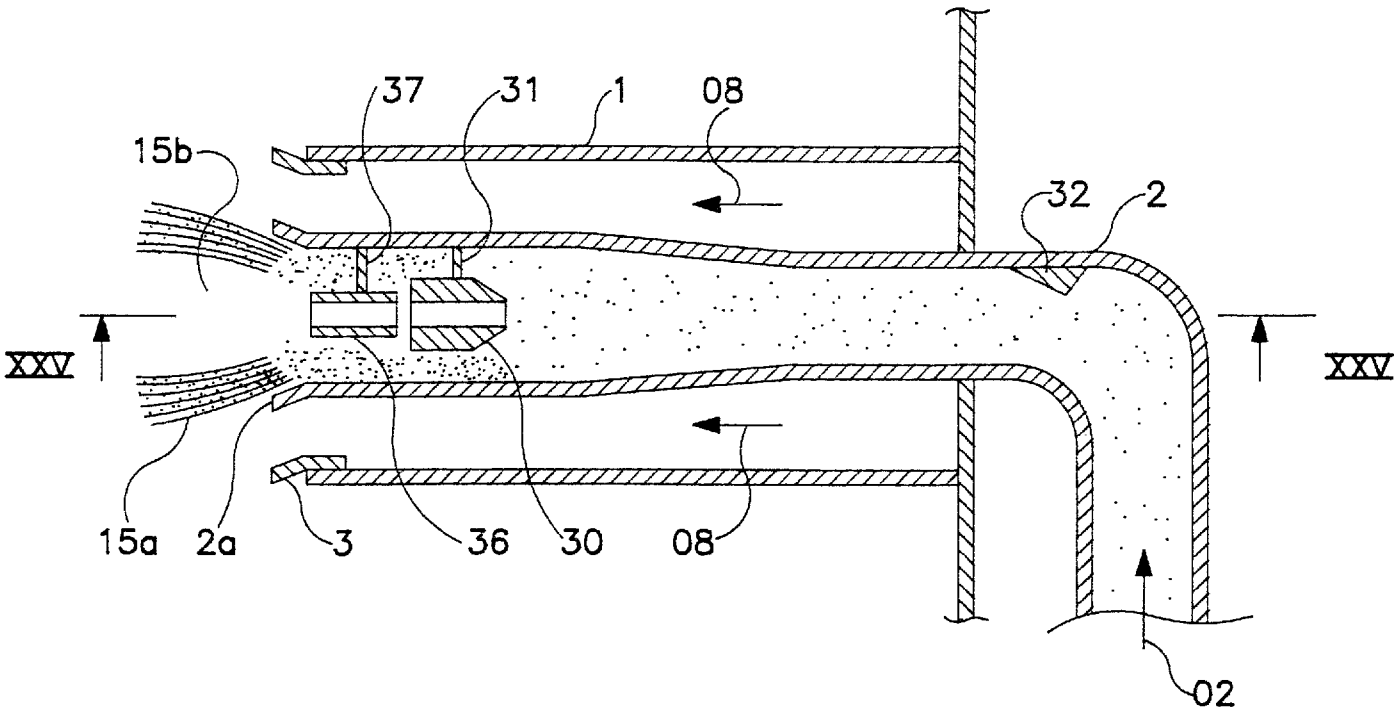
FIG. 26 is a sectional view taken along the line XXVI—XXVI of FIG. 25.
Figure 27:
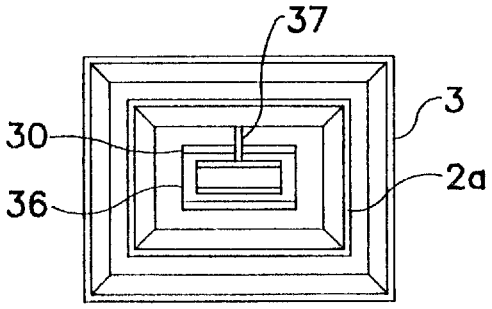
FIG. 27 is a frontal view of FIG. 26.
Figure 31:
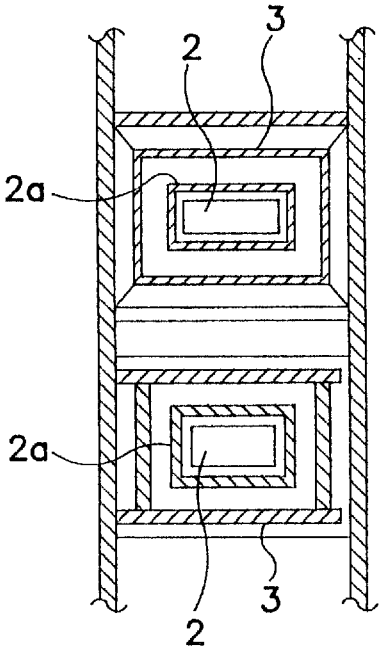
FIG. 31 PRIOR ART
FIG. 31 is a frontal view of FIG. 30.
Figure 28:
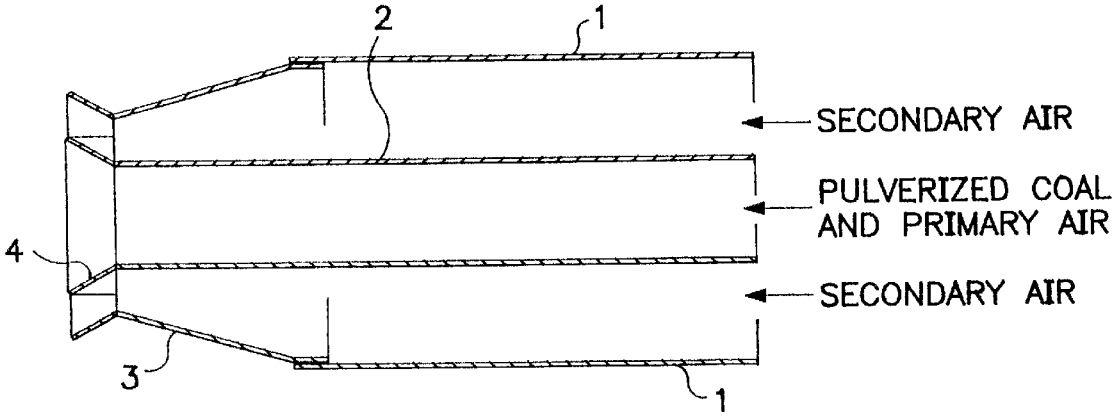
FIG. 28 PRIOR ART
FIG. 28 is a longitudinal sectional view showing a conventional pulverized coal burner.
Figure 29:
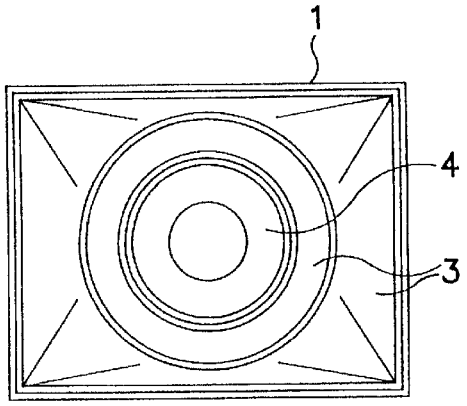
FIG. 29 PRIOR ART
FIG. 29 is a frontal view showing the pulverized coal burner of FIG. 28.
Figure 30:
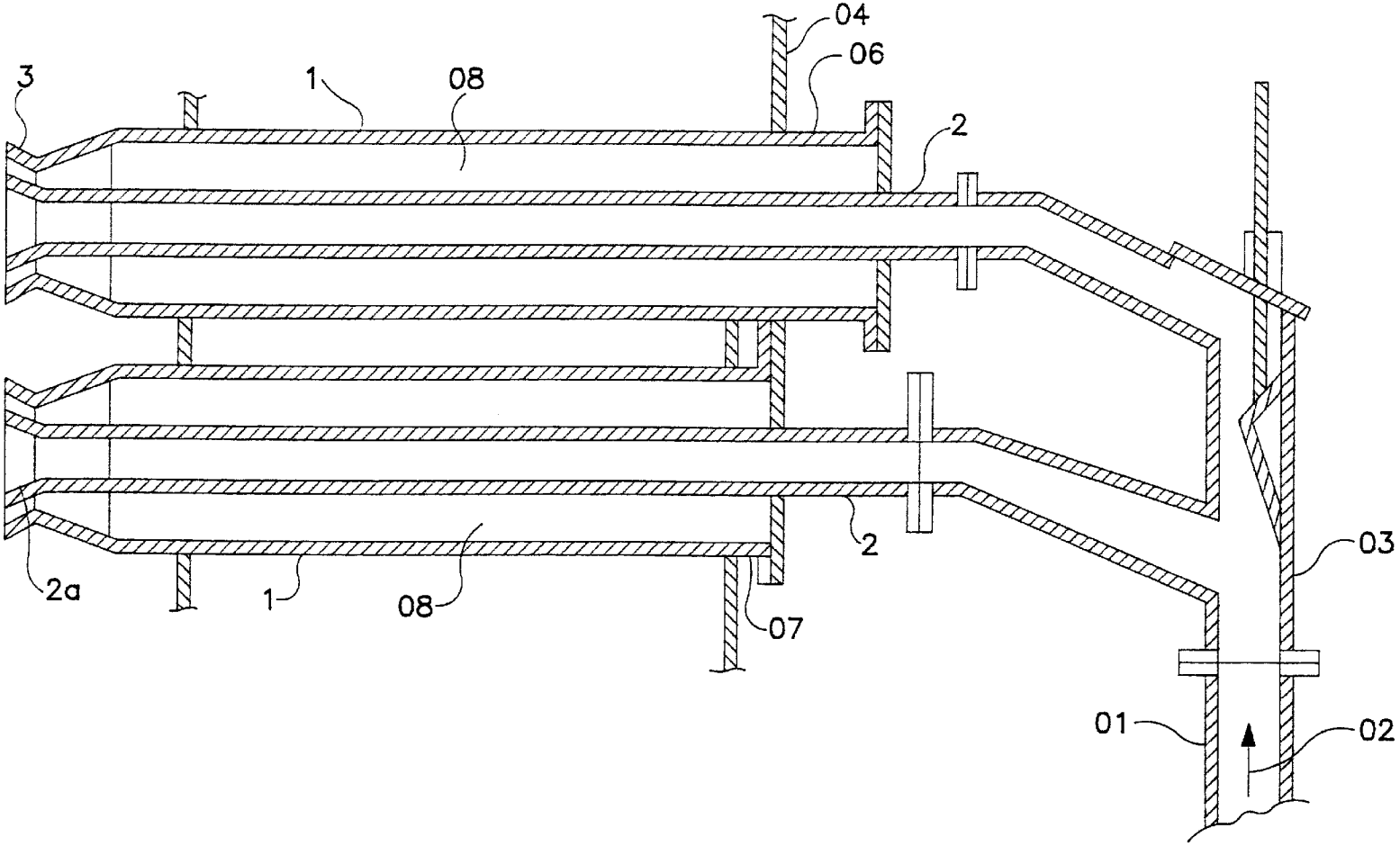
FIG. 30 PRIOR ART
FIG. 30 is a longitudinal sectional view showing an example of a conventional pulverized coal burner.
Figure 32:
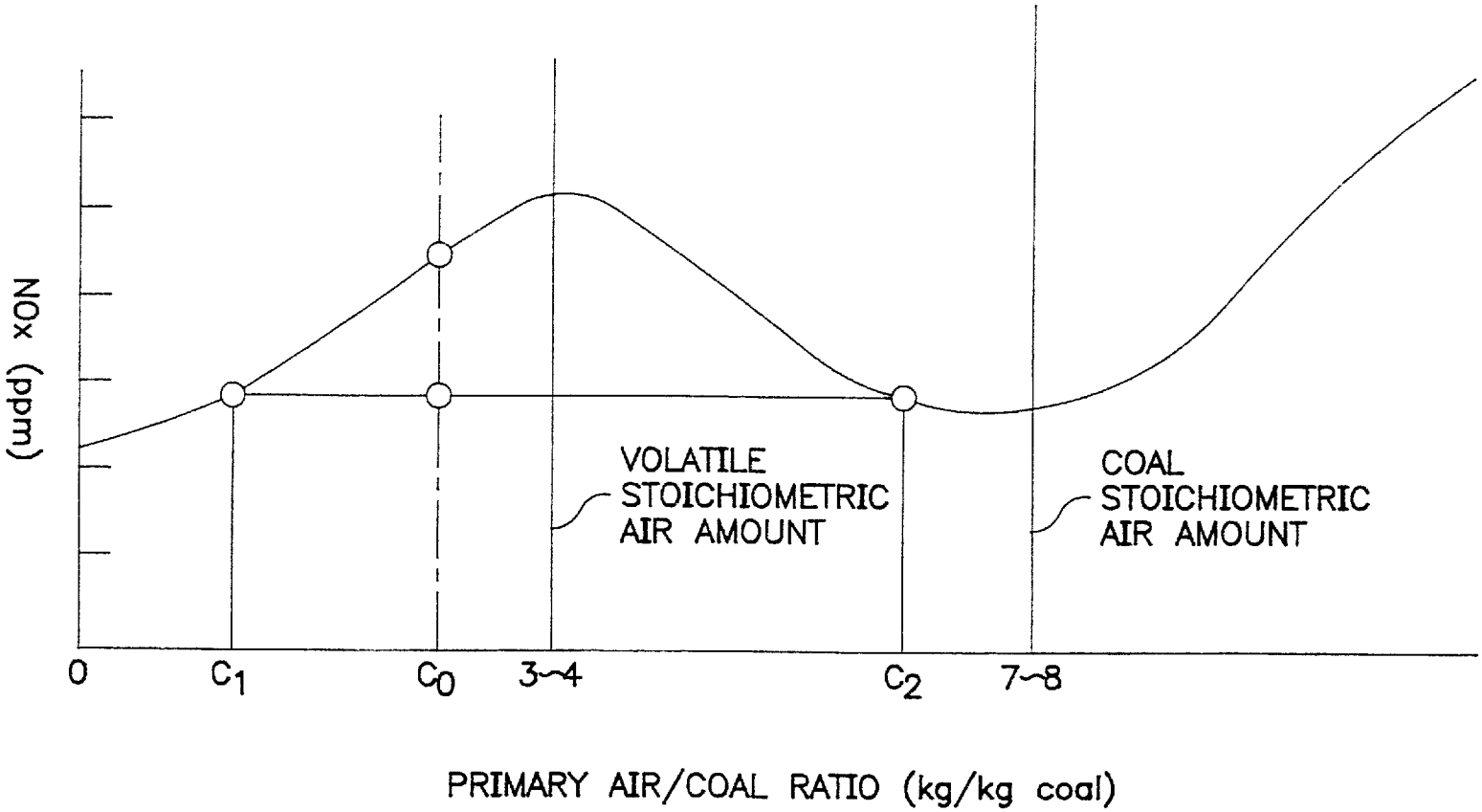
FIG. 32 is a graph showing a relationship of the air ratio of the air and the generated NOx amount of the pulverized coal burner.
Figure 33A:
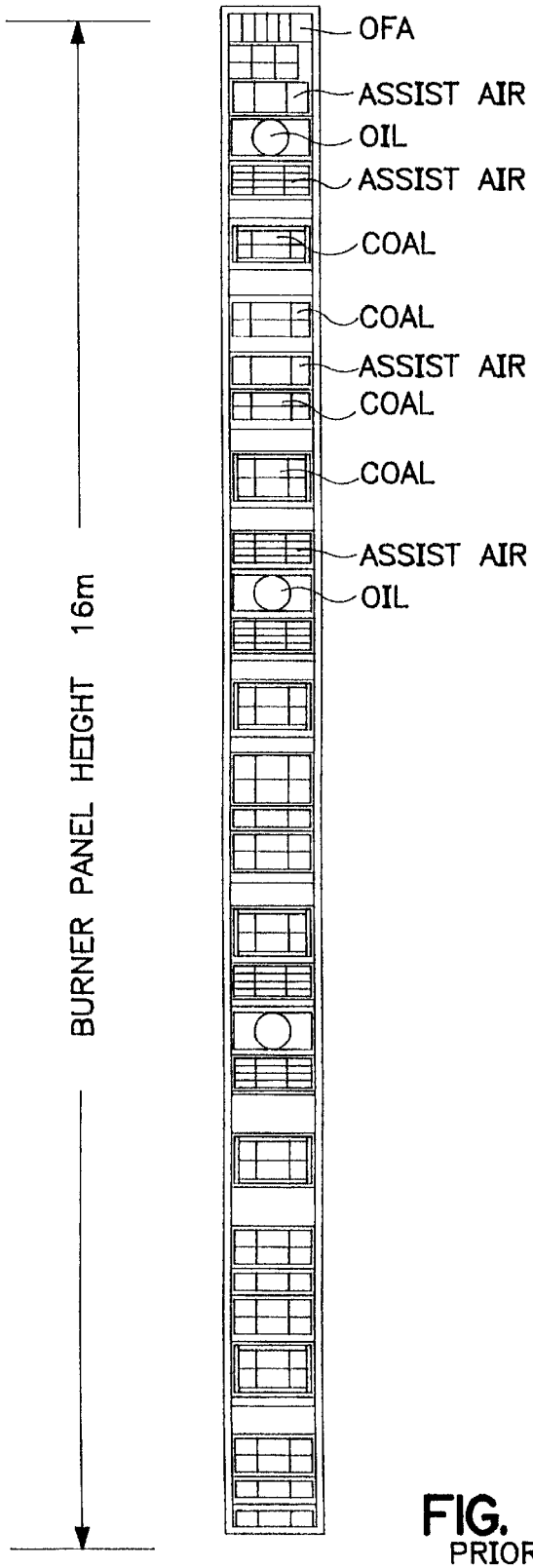
FIG. 33A PRIOR ART
FIG. 33 is a frontal view showing an overall arrangement between the conventional pulverized coal burner and a longitudinal sectional view showing a burner end portion.
Figure 33B:
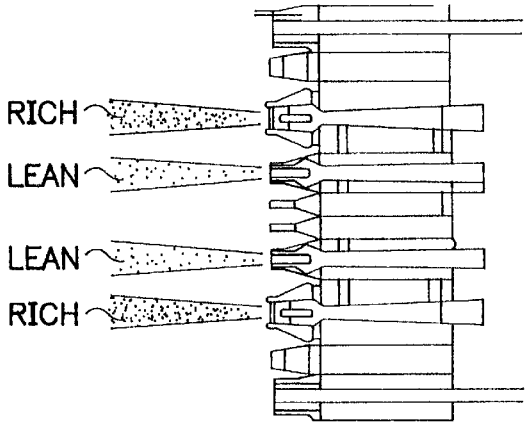
FIG. 33B PRIOR ART

FIG. 25 is a horizontal sectional view (sectional view taken along line XXV—XXV of FIG. 26) showing a ninth embodiment of the invention. FIG. 26 is a sectional view taken along line XXVI—XXVI of FIG. 25. FIG. 27 is a frontal view of FIG. 26. In these drawings, the same reference numerals are used to indicate the like members or components and the duplication of the explanation is avoided.

In this embodiment, a sleeve-like partitioning plate 36 is disposed in and vicinity of the downstream of the rich/lean separator 30. The partitioning plate 36 is mounted on the inner surface of the pulverized coal conduit 2 by a fastening member 37.

In the eighth embodiment, the mixture is separated into a mixture having a high concentration and a mixture having a low concentration immediately after the rich/lean separator. However, in some cases, the respective mixtures are again mixed before reaching the furnace to decrease the difference in concentration therebetween. If so, the low NOx performance of the burner may be damaged. Also, if the suitable concentration of the pulverized coal is not kept at the portion downstream of the flame maintaining plate, the ignition point is changed. In the worst case, a misfire would occur. In the eighth embodiment, as mentioned above, since the sleeve-like partitioning plate 36 is provided in the vicinity of and downstream of the rich/lean separator 30, the re-mixture of the rich mixture and lean mixture is prevented so that a low NOx combustion and ignition stability may be insured.

What is claimed is:

1. A pulverized fuel burner comprising:

a pulverized fuel conduit extending along a burner axis and having a tip end portion, said pulverized fuel conduit having a downstream flow direction;

a flame maintaining plate located at said tip end portion of said pulverized fuel conduit, said flame maintaining plate diverging gradually in the downstream flow direction;

a combustion assist air flow path formed around an outer side of said pulverized fuel conduit and an outer side of said flame maintaining plate;

a rich/lean separator provided within said tip end portion of said pulverized fuel conduit upstream of said flame maintaining plate;

a plurality of fins disposed in said combustion assist air flow path around the outer side of said flame maintaining plate; and a plurality of slits formed in said flame maintaining plate.

2. The pulverized fuel burner of claim 1, wherein each of said slits extends radially in said flame maintaining plate with respect to the burner axis.

3. The pulverized fuel burner of claim 1, wherein each of said slits forms an arc that extends concentrically in said flame maintaining plate around the burner axis.

4. The pulverized fuel burner of claim 3, wherein said slits are located in a portion of said flame maintaining plate having a diameter greater than the diameter of said pulverized fuel conduit.

5. A pulverized fuel burner comprising:

a pulverized fuel conduit extending along a burner axis and having a tip end portion, said pulverized fuel conduit having a downstream flow direction;

a flame maintaining plate located at said tip end portion of said pulverized fuel conduit, said flame maintaining plate diverging gradually in the downstream flow direction;

a combustion assist air flow path formed around an outer side of said pulverized fuel conduit and an outer side of said flame maintaining plate;

a rich/lean separator provided within said tip end portion of said pulverized fuel conduit upstream of said flame maintaining plate; and a plurality of slits formed in said flame maintaining plate.

6. The pulverized fuel burner of claim 5, wherein each of said slits extends radially in said flame maintaining plate with respect to the burner axis.

7. The pulverized fuel burner of claim 5, wherein each of said slits extends concentrically in said flame maintaining plate around the burner axis.

8. The pulverized fuel burner of claim 7, wherein said slits are located in a portion of said flame maintaining plate having a diameter greater than the diameter of said pulverized fuel conduit.

* * * * *